United States Patent [19]

Schmidt

[11] 4,043,151

[45] Aug. 23, 1977

[54] METHOD OF PRODUCING PILE OR PLUSH GOODS ON DOUBLE-BED CIRCULAR KNITTING MACHINES BY MEANS OF PLUSH HOOKS

[75] Inventor: Walter Richard Schmidt, Breisach Germany

[73] Assignee: Burlington AG, Switzerland

[21] Appl. No.: 469,875

[22] Filed: May 14, 1974

[30] Foreign Application Priority Data

May 23, 1973 Germany ..... 2326235
Mar. 25, 1974 Germany ..... 2414217

[51] Int. Cl.[2] ..... D04B 9/12

[52] U.S. Cl. ..... 66/9 R; 66/91; 66/194

[58] Field of Search ..... 66/91, 92, 93, 9 R, 66/191, 190, 194

[56] References Cited

U.S. PATENT DOCUMENTS

| | | | |
|---|---|---|---|
| 2,933,907 | 4/1960 | Lawson et al. | 66/93 |
| 3,224,225 | 12/1965 | Blore et al. | 66/9 R |
| 3,241,337 | 3/1966 | Stevens, Jr. | 66/9 R |
| 3,874,197 | 4/1975 | Plath | 66/92 X |

FOREIGN PATENT DOCUMENTS

| | | | |
|---|---|---|---|
| 1,273,404 | 5/1972 | United Kingdom | 66/9 R |
| 830,219 | 3/1960 | United Kingdom | 66/9 R |
| 820,872 | 9/1959 | United Kingdom | 66/91 |

*Primary Examiner*—Mervin Stein
*Assistant Examiner*—A. M. Falik
*Attorney, Agent, or Firm*—Cushman, Darby & Cushman

[57] ABSTRACT

The present invention relates to a method of producing pile or plush goods or fabrics on circular knitting machines with plush hooks in the cylinder and latch needles in the dial and circular double knitting machines by means of pile hooks in a needle bed. Certain selected pile hooks are raised prior to the needles in order to prevent the fabric from raising with the needles while the pile hooks which are not selected for the formation of pile loops are retracted prior to the feeding of the pile yarn. Subsequent to the formation of the pile loops, the pile hooks are advanced into the loop forming position by the stitch cam until the needles move into an inactive position after the stitch formation, in order that the stitches are relieved (from tension) and withdrawn from the dial.

7 Claims, 21 Drawing Figures

METHOD OF PRODUCING PILE OR PLUSH GOODS ON DOUBLE-BED CIRCULAR KNITTING MACHINES BY MEANS OF PLUSH HOOKS

The present invention relates to a method of producing pile or plush goods on circular knitting machines with plush hooks in the cylinder and latch needles in the dial, whereby the interlacement or anchorage of the pile or plush loops may be effected both as a stitch and as a tuck loop, whereby the pile or plush loops may be formed (looped or knitted) as long as possible, and whereby a correct stitch pattern is formed. In this way it is possible to produce, in addition to the previously known fields of use of pile fabrics, such as underwear, children's and sportswear, also particularly dense pile fabrics which may be used as carpets, upholstering and covering cloth.

In view of the fact that such circular knitting machines (double knit machines) are not usually provided with holding down sinkers, it is difficult to knit a course of stitches with all of the needles (in the dial or cylinder), especially if the stitches are knitted by the horizontal needle bed, i.e., the rib disc or dial. Therefore, it is necessary to prevent the last course stitches from moving or raising together with the needle and to withdraw them from the rib (dial) needle, in order to prevent an enlargement of the part of the stitch consisting of the pile or plush yarn. If the pile yarn is interlaced as a tuck loop, a secure interlacement within the base fabric is required.

Numerous methods are known for the production of pile fabrics on circular knitting machines.

In flat knitting machines, the pile yarn is fed to the needles of both needle beds by means of a customary yarn carrier. At the same time, the needles of a needle bed are fed with the base yarn, and these needles then form the base fabric from both yarns. The needles of the other needle bed are again raised into the knitting position and thereafter retracted again, whereby the pile loops are cast-off or cleared.

According to German Pat. No. 1,169,073, this principle is adapted to circular knitting machines. In order to avoid the additional needle movement for casting off the plush or pile loops and to eliminate the shearing operation in the production of shear or cut plush, the plush or pile loop is cut in the machine. However, this requires a special dial (rib disc) construction. Besides, impairment of the knitting process by the severed waste portions of the plush loops cannot be avoided.

In order that the plush or pile loops can be cast off without any additional needle movement, pile needles or pile hooks are installed in the place of one set of the knitting (latch) needles of a needle bed.

When using pile needles, i.e., pin-shaped needles or sinkers without needle hook and latch, the pile and base yarns are fed in the same manner as in the above described process. However, the pile needles remain in the knit or tuck position, while the base fabric is knitted on the other needle bed so as to form the pile loops over the shanks of the pile needles. It is only then that the pile needles are brought into the cast-off position thereby to cast off the pile loops.

If the pile needles are positioned in the dial (rib disc), the length of the pile loops can be easily adjusted by vertical adjustment of the dial; however, few possibilities of patterning exist thereby.

When arranged in the cylinder, a patterning is possible by a selection of the pile needles by means of the customary pattern attachments; however, different lengths of the pile loops necessitate pile needles of different configuration.

By using pile hooks, the length of the pile loops can be varied by means of the adjustable stitch cam. Pile hooks are employed in various methods.

In a method as described in Swiss Pat. No. 456,829, the base and pile yarns are formed into loops by hooks. During cast-off, the pile loop is guided (held) by the back of the base yarn hook, and such loop is thereafter cast off.

In the method known from German Pat. No. 1,816,864, the pile loops are formed before the stitch formation is performed.

Accordingly, the last two mentioned methods suffer from the disadvantage that the pile loop is shortened by the subsequent knitting process. As in every continuous loop formation, the desired length of the pile loop must be reached when the formation of the next following loop starts; this means that in the case of fine gauge machines it is not possible to form long pile loops. If the pile loops are interlaced by every second needle, longer pile loops are obtained but there results a reduced rate of production because the base fabric is likewise knitted only by every second needle.

If one operates with all needles (i.e., all latch needles) in the above mentioned methods there exists the possibility that the stitches might rise with the needles so as to be damaged by the pile hooks.

In double knit machines, it is customary to prevent such stitch movement by bringing the needles of one needle set into the tuck position prior to the needles of the other needle set, and by withdrawing these needles prior to the yarn feeding, whereby no needle of this needle set knits at this knitting feed.

In order to obtain a proper stitch pattern, loop structure of plating effect in the method according to Swiss Pat. No. 456,829 the plush loop is kept tensioned over the back of a second hook during the casting off of the stitches. In the method according to German Pat. No. 1,816,864, the pile loop is relieved during the stitch formation and thereafter re-tensioned or stretched again in the following feed of a guiding cam. In addition to the common disadvantage that the length of the pile loops can be varied to limited degree only by means of the pile hook retracting cam, in the method according to German Pat. No. 1,816,864 the double-thread plush stitches are cast off from single-thread base stitches. These single-thread base courses reduce the loop density.

In order that the length of the pile loops is not reduced, these loops may be interlaced into the base fabric as tuck loops. In this way, the yarn size of the pile yarn does not so much depend on the gauge of the machine and needles; lighter fabric weights are obtained with identical plush density than possible in the case of stitch tie up or interlacement.

A method of this kind is described in British Pat. No. 830,219. In such method, the pile loops are formed between alternate needle shanks or stems of alternating needles and then knitted from these needles. In this method, the pile yarn may be easily released from the base fabric.

This disadvantage is avoided in the method according to U.S. Pat. No. 2,933,907 by performing the formation of the pile loops and the interlacement in a plain jersey course in separate steps of operation. The pile loops are prevented from raising with the needles during the knitting process by a guiding attachment only, and this operation can be performed by such portion only with a very exact adjustment thereof. The knitting of the pile loops and of the base fabric in separate steps of operation reduces the number of the feeds (systems) on the circumference of the machine and, thus, the capacity of the latter.

Accordingly, it is the object of the present invention to prevent raising of the fabric along with the needles in the production of pile goods on circular knitting machines as described above, to obtain a maximum length of the loops by a simultaneous knitting of the pile loops and the stitches, or to form a tight bond of the plush loops with the base fabric by interlacement of the pile loops as tuck loops in a single step of operation, respectively, and to obtain a perfect loop structure in each of these possibilities.

This object is attained by a method wherein all pile hooks are raised before the latch needles and the pile hooks which are for knitting pile loops are retracted prior to the feeding of the pile yarn, and wherein after the knitting of the loops the retracting pile cam advances the plush hooks into the loop forming position until the stitches are relieved and drawn out from the dial.

In order that in a pattern control (i.e., selection of pile hooks) the pile yarn is always positively engaged by the pile hooks, these hooks upon the feeding of the pile yarn are retracted to such an extent that the yarn is held by the hooks above and on the needles until the formation of the pile loops is effected simultaneously with the casting off of the stitches.

If the pile loops are tied or interlaced as tuck stitches, a tight bond to the base fabric is obtained either by forming the pile loops between every second needle shank and thereafter raising alternate needles into the knitting or tuck position in the same step of operation, or by forming the pile loops between the needle shanks of all needles and then dividing them in two alternate groups and retracting each group alternately to the tuck-on-the-needle position, whereby on base yarn is fed to each group.

The advantages to be obtained by the present invention reside in the fact that no faults are caused which are due to the raising of the fabric along with the needles, that in each embodiment pile loops of maximum length can be formed and varied or adjusted as desired by means of the pile hook retracting cam, and that a sufficiently tight bond or interlacement of the pile loops with the base fabric is obtained. If the pile loops, in the case of a tuck stitch interlacement, are maintained very short, single-knit laid-in fabrics are formed. If the pile loops are capable of forming pile loops of different lengths, this feature can be utilized for patterning purposes in order to place pile and laid-on faces in side-by-side relation.

In the following, exemplary embodiments of the invention are explained in greater detail by referring to the enclosed drawings, wherein.

Figure 1:
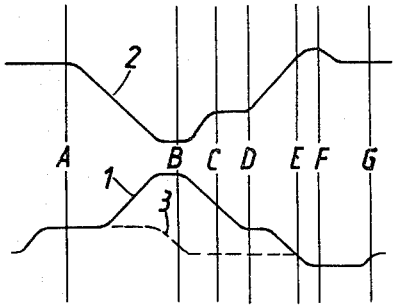
FIG. 1 is a motion diagram of the needles and pile hooks in the interlacement of the pile loops as a stitch.
Figure 4:
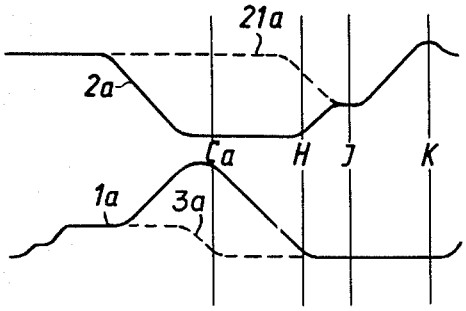
FIG. 4 shows a motion diagram of the needles and pile hooks to illustrate a possibility of anchorage of the pile thread in the fabric by means of tuck stitches.
Figure 5:
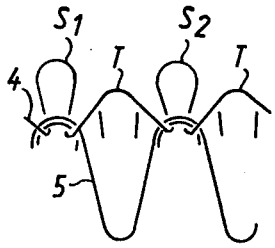
Figure 6:
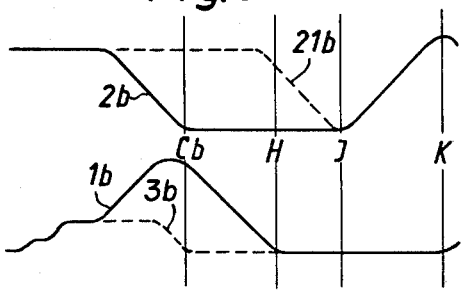
Figure 7:
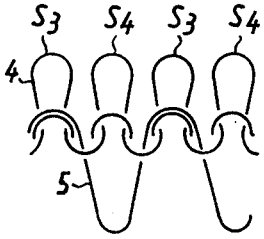
Figure 8:
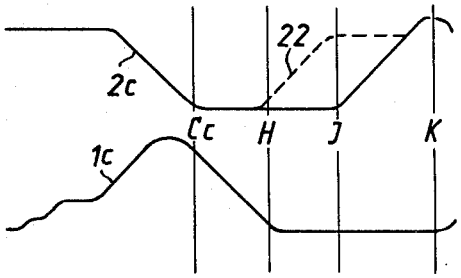
Figure 9:
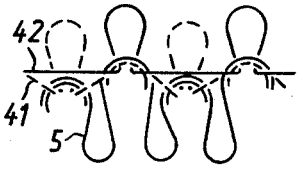
Figure 4A:
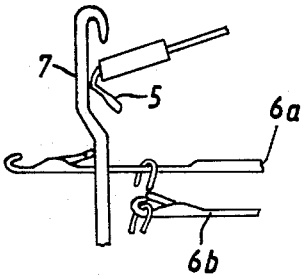
Figure 4B:
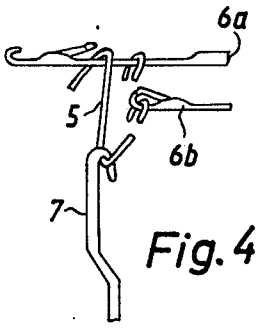
Figure 4C:
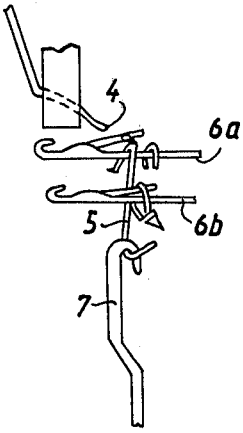
Figure 6A:
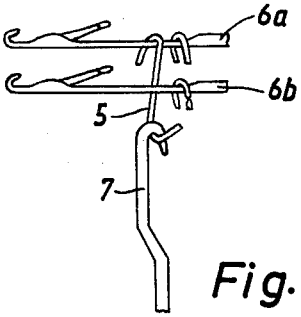
Figure 8A:
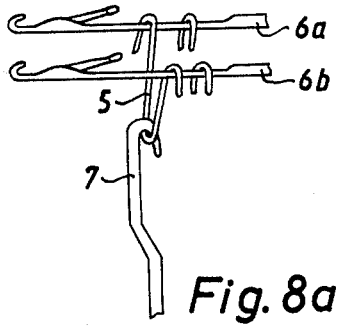
Figure 10:
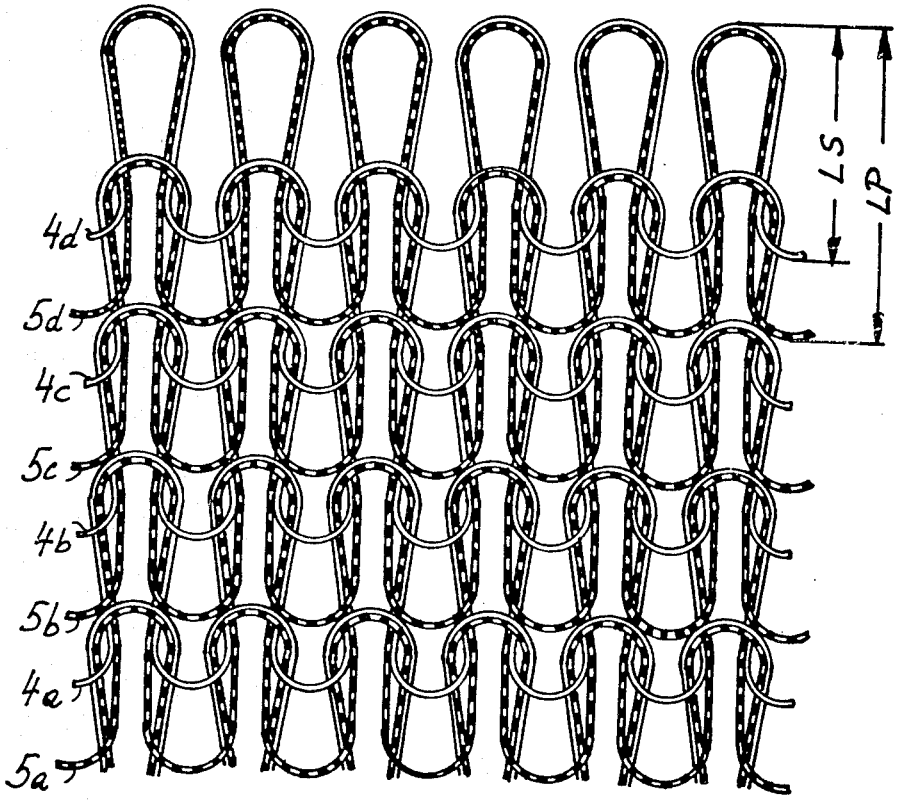

FIG. 4*a* shows the position of the needles and pile hooks during the feeding of the pile yarn at the position Ca of FIG. 4;

FIG. 4*b* shows the position of the needles and pile hooks after the formation of pile loops at the position H of FIG. 4;

FIG. 4*c* shows the position of the needles and pile hooks during the feeding of the base yarn at the position J of FIG. 4;

FIG. 5 shows the pattern of the thread of a course which has been knitted according to FIG. 4;

FIG. 6 shows another motion diagram of the needles and pile hooks for the anchorage of the pile thread or yarn in the fabric as a tuck stitch;

FIG. 6*a* shows the positioned of the needles and pile hooks at the position L of FIG. 6;

FIG. 7 shows the pattern of the thread of a course which has been knitted according to FIG. 6;

FIG. 8 shows a motion diagram of needles and pile hooks in order to anchor the pile yarn as a tuck stitch in the fabric in accordance with another possibility;

FIG. 8*a* shows the position of the needles and of the pile hooks upon feeding the first base yarn at the position N of FIG. 8;

FIG. 9 shows the pattern of the thread in a course which has been knitted according to FIG. 8; and FIG. 10 shows the loop formation resulting from the FIG. 1 layout.

As can be seen from the motion diagram of FIG. 1, the pile hooks 7 (curve 1) are raised prior to the dial needles 6 (curve 2), (see FIG. 1 Position A) whereby the plush loops are cleared. These plush loops may be brought into a position between the dial and the cylinder by a laser (thin blade or guiding attachment). In the raising of the needles, the raised pile hooks prevent the stitches formed last from rising with the needles. It should be understood that when the pattern is being controlled (i.e., jacquard) only the selected pile hooks are raised into their uppermost position (Position B). While the needles are retracted into the feeding position, all pile hooks which have not been selected for the pile loop formation are retracted according to curve 3 to an idle position. The pile yarn is placed into the pile hooks (Position C), and these pile hooks are retracted to such an extent that the pile yarn is safely positioned on the hooks of the needles (Position D).

Figure 1A:
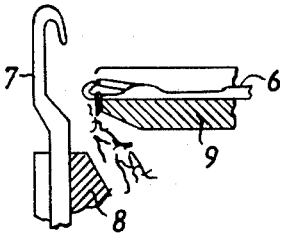
Figure 1B:
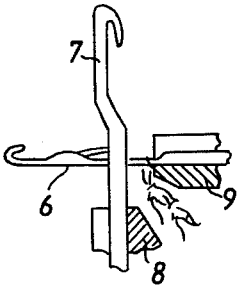

Hereby, the needles and pile hooks move from the left to the right. The pile hooks are raised while the needles are still in the idle position. This corresponds to position A of the diagram of FIG. 1, and this condition is shown in FIG. 1*a* as seen from the side. Raising of the pile hooks 7 releases or clears all of the previously formed pile loops such that they can be brought into a position between cylinder 8 and dial 9 by means of a conventional mechanical or pneumatic device (not shown). Then, the dial needles are raised (curve 2), whereby the raised pile hooks prevent the last-formed stitches from being raised with the needles. Also, the pile hooks have been moved further up to their uppermost position which these hooks reach in the position B together with the dial needles. The side view is shown in FIG. 1*b*.

Figure 2:
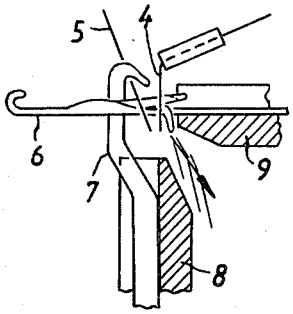
FIG. 2 is a fragmentary vertical sectional view showing the position of the needles and pile and the feeding of a base yarn hooks after the feeding of the pile yarn.
Figure 1C:
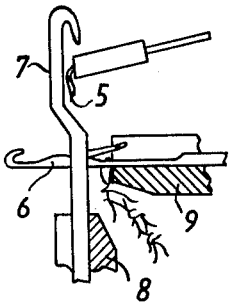

When the pile hooks have been selected by a pattern device (jacquard attachment) for the formation of the pile loops, all of the pile hooks which remained in the pile clearing position of FIG. 1*a*, are retracted into the idle position as shown by curve 3. At the same time, the rib or dial needles are also moved into the feeding position (point C of the diagram of FIG. 1), and the pile yarn is fed. This position is shown in FIG. 1*c*. The last-formed stitches are located behind the latches of the dial needles, and the pile yarn 5 is inserted into the pile hooks 7 by means of a yarn carrier. While the needles continue to remain in the feeding position for receiving the base yarn, the pile hooks are retracted until their hooks hold the pile yarn above the opened needle latches. In this way, withdrawal of the pile yarn from the hook portions of the pile hooks can be prevented. Then, the base yarn 4 is fed to the needles 6. FIG. 2 shows the corresponding position of the needles 6 and of the pile hooks 7 as well as of the base yarn 4 and of the pile yarn 5, which position is reached at point D of FIG. 1.

Needles mounted in a dial 9 are in the feeding position such that the base yarn 4 may be fed thereto. Hereby, the last stitch S formed by needle b is positioned behind the open latch of needle 6. In a cylinder 8, pile hooks 7 are mounted which positively guide a pile yarn 5 in their hooks. This position of the pile hook is significant for the reason that the pile yarn 5 for knitting must be drawn into the dial 9 by the needles 6; however, if the stitches and pile loops are formed simultaneously, the danger exists that the pile yarn might be drawn out from the pile hooks by the needles retracting to the dial. Therefore, the pile hook must engage the pile yarn timely enough in order to counteract the tension caused by the stitch formation.

Upon feeding the base yarn 4, the needles and the plush hooks are moved into the cast-off position (Position F). Hereby, the needles knit common stitches from the base yarn 4 and from the pile yarn 5, while the pile hooks form pile loops from the plush yarn 5.

Figure 2A:
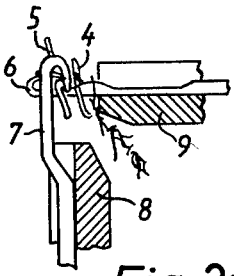

This is accomplished as follows:

While the pile hooks 7 continue to stay in their position, the needles 6 are retracted such that the needle latches close the needle hook. As shown in FIG. 2*a*, the pile yarn 5 is hereby guided by the pile hook 7. This position is indicated at E in FIG. 1.

Now, the pile hooks 7 and the needles 6 together are drawn into their lower most position (FIG. 1, point F). As the pile yarn is drawn into several directions at the same time by the needles 6 and the pile hooks 7, a pile loop of optimum length can be formed.

Figure 2B:
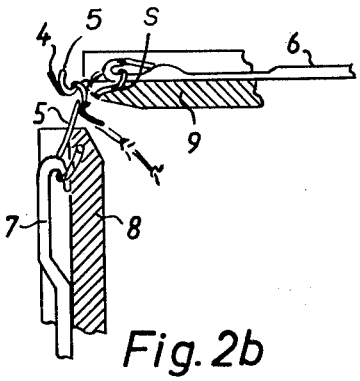

In FIG. 2*b*, this position is shown from the side. By its retraction into the dial 9, the needle 6 has formed a common stitch from the base yarn 4 and from the pile yarn 5, and the pile loop 5 has been formed by the pile hook 7.

As the pile loop is longer than the stitch formed of the base yarn, only the latter is affected by the fabric take-up means. After the needles have been released by the stitch cam and come into the idle position, it could happen that the stitch formed from the pile yarn 5 remains in the illustrated position of FIG. 2*b* when the pile loops are relieved untimely, and is again enlarged by the following needle movement, which would result in a poor stitch pattern. Therefore, the pile hook 7, a shown in the position G of FIG. 1 and as shown in side view in FIG. 3, remains in its lowermost position, whereby the stitch formed from the pile yarn 5 remains under tension and is withdrawn from the slots of the dial so as to avoid so-called faults of plating. It is also possible to further retract or withdraw the pile hooks after the needles have been brought into the idle position from their cast-off position, in order to increase the tension of the pile yarn. Thereupon, the pile hooks are raised to release (cast-off) the pile loops, and a new stitch forming cycle starts. As can be seen from the loop pattern shown in FIG. 10, each stitch course comprises a thread 4 (base yarn) and a thread 5 (plus yarn). Both threads are knitted into stitches as shown. While the base yarn forms loops having a stitch size LS, the plush yarn must form longer loops LP. As is well known, the height of the pile is the difference between LP and LS.

Figure 3:
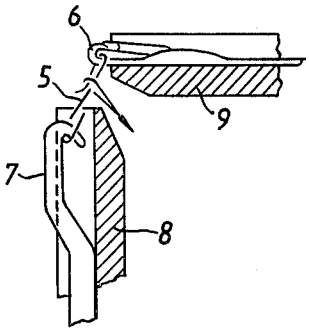
FIG. 3 is a fragmentary vertical sectional view showing the position of the needles and pile hooks after the formation of stitches and pile loops.

Thus for FIG. 3, the needles are moved into an inactive (idle) position, and the stitches are relieved (see FIG. 1 Position G). Since during knock-over the base yarn 4 and the plush yarn 5 are drawn by needle 6 with tension through the last formed stitch S into the dial. In this position, the needle hooks are at the elevation of the dial diameter (periphery) or slightly above such diameter. As the pile yarn 5 formed into pile loops is maintained tensioned or stretched by the pile hooks 7 remaining in the loop forming position, the thus formed stitches are withdrawn out of the dial. In this way, it is assured that the needles in the subsequent raising movement do not penetrate through the stitches or stitch portions of the previously formed course so that an imperfect stitch pattern would be produced.

FIG. 4 shows a sequence of operation of the dial needles in accordance with curves 2*a* or 21*a* and of the pile hooks in accordance with curves 1*a* or 3*a*, whereby the needles and pile hooks move from the left to the right.

In the customary manner, the dial uses needles having alternating long and short needle shafts, whereby independent control of both needle groups is rendered possible.

As in FIG. 1, in FIG. 4 the pile hooks are also raised to release (cast-off) the pile loops as shown in curve 1*a* (FIG. 1*a*), while all of the rib or dial needles remain in the idle position. The pile loops are moved between dial and cylinder, and the alternate dial needles 6*a* (curve 2*a*) are brought into their uppermost position (FIG. 1*b*) together with the pile hooks (curve 1*a*). Pile hooks which are not to form pile loops, are retracted into the idle position (curve 3*a*).

While the alternate dial needles continue to stay in their uppermost position, the pile hooks 7 are fed with the pile yarn 5 (FIG. 4*a*) in the position according to point Ca in FIG. 4. The dial needles 6*b* further stay in the idle position (curve 21*a*). The pile hooks are retracted with the pile yarn 5 fed thereto, and they reach their lowermost position at point H of FIG. 4. The pile hooks stay in this position until the dial needles 6*a* and 6*b* have left their cast-off position (point K in FIG. 4).

As shown in FIG. 4*b*, the pile yarn 5 is formed into pile loops by the pile hooks 7 between the needle shafts of the alternate dial needles 6*a*. Thereupon, the short rib or dial needles 6*b* are brought into the tuck position as shown in curve 21*a* whereby the latches are opened by the previously formed stitches. At the same time, the dial needles which are in a clearing position are retracted into the feeding position, while the previously formed stitch and the pile loop formed by the pile hook 7 are moved to the rear of the latch. At point J of FIG. 4, the base yarn 4 is fed to the long and short rib or dial needles. As shown in FIG. 4*c*, the stitches of the short rib or dial needles 6b are still located on the latch. Along with the fed base yarn, dial needles 6a and 6b are retracted or withdrawn into the cast-off position (point K of FIG. 4), whereby alternate dial needles 6a knit stitches and the other dial needles 6b knit tuck stitches. Thereupon, the rib or dial needles are brought into the idle position by slightly raising them. As the pile hooks 7 have held the pile loops under tension, these hooks withdraw the pile loops from the slots of the dial.

FIG. 5 illustrates the pattern (of extension) of base yarn 4 and pile yarn 5 within a fabric which has been knitted as described in connection with FIG. 4. The base yarn 4 has been knitted into needle loops S1 and S2 by the alternate dial needles 6a, while dial needles 6b have knit the tuck stitches. The pile yarn 5 is tied into the needle loops S1 and S2 as tuck stitches. By means of the interconnecting sinker loop extending from the needle loop S1 to the tuck loop T and from the latter to the needle loop S2, a tight bond between the base fabric and the pile loops is obtained as is obtained in a laid-in fabric.

It is self-evident that in the next cycle of operation the alternate dial needles 6b are raised fully, whereby the pile loops are formed between their shafts and stitches are knitted with the base yarn 4. The dial needles 6a are brought into the tuck position, same as the short rib or dial needles 6b have been moved before, and the dial needles 6a knit tuck loops from the base yarn. Thus, stitches have been formed by all needles; that is, a complete course has been finished after the needles and pile hooks have passed throught two feeds.

In a fabric of this type, the number of the pile loops corresponds to the number of the stitches, such that this fabric is very dense. Besides, the above-described mode of operation offers the advantage that in the case of a break of the base yarn, not all of the stitches are cast off from the needles such that such faults can be remedied easily.

Another possibility of anchorage is shown in FIG. 6. In this case, dial needles 6a and 6b are moved in accordance with curves 2b and 21b, and the pile hooks 7 are moved in accordance with curves 1b and 3b up to position H, same as in FIG. 4. At point Cb, the pile yarn 5 is fed to the pile hooks, which hooks again form pile loops between alternate dial needles 6a. However, dial needles 6b, which remained in an idle position, are then brought into the knitting position beyond the tuck position. As can be seen from FIG. 6a, the stitches are thereby moved behind the needle latches. After dial needles 6a and 6b have been retracted slightly, the base yarn 4 is fed and knitted into stitches by all of the dial needles (FIG. 6, point K). As soon as the needles 6a and 6b relieve the stitches by a slight raising movement, the stitches are withdrawn from the slots of the dial by the tensioned pile loops.

FIG. 7 shows the tie up of the pile yarn 5 into the base yarn 4 which has been knitted into needle stitches S3 by the alternate dial needles 6a and into needle stitches S4 by the other dial needles 6b. Each pile loop is held on the one side by the sinker stitch interconnecting the needle stitches S3 and S4, and on the other side by the sinker stitch interconnecting the needle stitches S4 and S3. In this way, the desired tight bond between the pile loops and the base fabric is obtained.

The fabric produced according to FIG. 6 comprises pile loops only in a number equal to one-half of the number of stitches. Due to the possibility of using coarse thread size numbers for the pile yarn, a tight or dense pile fabric is nevertheless provided. A high production rate is achieved because of the fact that all dial needles form stitches at every feed. In the successive cycles of operation, the pile loops should be formed in alternating fashion between the shafts of alternate dial needles; however, any desired other sequences are possible as well.

Figure 8B:
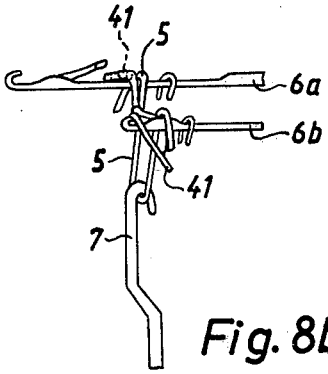

A third possibility is shown in FIG. 8. As according to FIG. 1, all needles 6a and 6b, as shown by curve 2c, and all pile hooks 7, as shown by curve 1c, are brought into their uppermost position (FIG. 1b). Thereupon, the pile yarn 5 is fed to the pile hooks 7 (point Cc of FIG. 8), and the pile hooks are retracted into their lowermost position. The hooks reach this position at point M in FIG. 8. As shown in FIG. 8a, the pile yarn 5 is thereby formed into pile loops by the pile hooks 7 between the shafts of needles 6a and 6b. Then, dial needles 6b (curve 22) are retracted into the feeding position, a first base yarn 41 is fed, and the needles are further retracted up to the position "tuck-on-the-latch" (point N of FIG. 8). As shown in FIG. 8b, the base yarn 41 is thereby brought at the rear of the latches onto the shafts of the dial needles 6a while being positioned within the closed hooks of the retracted dial needles 6b. Now, the long rib or dial needles 6a are also retracted into the feeding position, the second base yarn 42 (shown in FIG. 9) is fed, and the needles are further retracted until the dial needles 6a and the short rib or dial needles 6b are simultaneously retracted into the cast-off position. In this condition, the short rib or dial needles 6b knit stitches from the base yarn 41, while the long rib or dial needles 6a knit tuck loops from the base yarn 41 and stitches from the base yarn 42.

It is self-evident that in the next cycle of operation the alternate dial needles 6a can be retracted first with a base yarn 41, followed by the dial needles 6b. This operation results in a uniform base fabric.

FIG. 9 illustrates the anchorage of the pile yarn into the base yarns 41 and 42. Each loop formed from the pile yarn 5 is closely anchored (bonded) on the one side by the base yarn 41 and on the other side by the base yarn 42.

Thus to summarize, the needles and pile hooks are operated whereby the pile loops are interlaced or tied up with tuck stitches. As described, the pile hooks are raised in order to prevent the fabric from moving with the needles and to cast off the loops (curve 1). Alternating needles are raised as shown in curve 2, and after the non-selected pile hooks are retracted prior to the feed of the pile yarn, (see FIG. 4 Position Ca) the pile loops are formed behind the needle latches on the needle shanks (see FIG. 4 Position H). While the pile loops are further held under tension by the stitch cam, the needles which formerly remained in the inactive position are brought into the tuck position (curve 21a). At the same time, the fully raised needles are retracted into the feeding position (see FIG. 4 Position J). A base yarn is fed, and the needles are contracted into the cast-off position (see FIG. 4 Position K). In this way, the pile loops are cast off the dial needles. The thus formed 1:1 tuck course of the base fabric makes it impossible for the pile loops to be released from the fabric (see FIG. 5).

FIG. 5 shows the interlacement of the plush yarn 5 in the base yarn 4 which knits stitches and tuck loops.

In contrast with FIG. 4, in the operation diagram according to FIG. 6, the dial needles which are not raised for the formation of pile loops are moved into the knitting position (curve 21), (See FIG. 6 Position J).

Accordingly, the base yarn 4 is knitted into a plain course (FIG. 7).

According to FIG. 8, all pile hooks (curve 1) and all dial needles (curve 2) are brought into the knitting position. (See FIG. 8 Position G). After the pile hooks have formed the pile loops (see FIG. 8 Position H), every second needle is retracted into the tuck-on-the-needle position, whereby a first base yarn is fed (see FIG. 8 Position J). In this way, this yarn is positioned rearwardly of the needle latches on the shafts of the needles which are still in the knitting position. These needles engage a second base yarn and are retracted. Hereby, all needles are retracted into the cast-off position (see FIG. 8 Position K), and they knit two 1:1 stitch courses from the two base yarns.

In FIG. 9, the pile loops formed from the pile yarn 5 are interlaced by the base yarn 41 which forms a 1:1 tuck course, and by the base yarn 42 which has been knitted into a floated 1:1 course.

In an interlacement of the pile loops as stitches the pile hooks may be selected as desired. However, in the interlacement as a tuck stitch pile loops must always be formed between all needles or between every other needle. A patterning effect can be obtained by different loop lengths only.

What we claim is:

1. A method of producing pile fabrics on circular knitting machines including dial needles and pile hooks in the cylinder, wherein the pile loops are released from said hooks by raising the pile hooks to a position beneath the dial and the cylinder, the improvement comprising maintaining said pile hooks in a raised first position, advancing the dial needles between the pile hooks, thereby preventing the stitches formed last from moving together with the needles, further advancing a first set of pile hooks to a raised second position, retracting a second set of pile hooks which are not selected for the formation of pile loops, feeding a pile yarn to the dial needles and the raised pile hooks and a base yarn to the dial needles, forming pile loops with the pile yarn by partially retracting the raised first set of pile hooks to position the pile yarn on the dial needles and holding the pile hooks in their partially retracted position after the knitting of the pile yarn as stitches or tuck stitches into the base yarn stitches until the dial needles are moved from a cast-off position into an idle position.

2. The method according to claim 1 wherein said pile hooks hold the pile yarn above the opened hooks of the dial needles until the dial needles form stitches and the pile hooks form pile loops by simultaneously retracting said dial needles into the dial and said pile hooks from their held position into their lowermost position.

3. A method according to claim 1 further comprising the steps of:

raising one set of alternate dial needles to the clearing position, forming the pile loops between the needle shanks of said dial needles raised to the clearing position, thereafter raising a second alternate set of dial needles from the idle position to a tuck position, feeding a base yarn to all needles and retracting all dial needles to knock-over position so as to knit said base yarn into alternating stitches and tuck loops.

4. A pile fabric produced in accordance with the method of claim 3, wherein the courses of the base fabric comprise 1:1 tuck loops, with a pile yarn in every second wale forming a tuck loop.

5. A method according to claim 1 further comprising the steps of:

raising one set of alternate dial needles to the clearing position, forming pile loops between the needle shanks of said dial needles raised to the clearing position, thereafter raising a second alternate set of dial needles from the idle position to a clearing position, feeding a base yarn to all needles and retracting all needles to the knock-over position so as to knit said base yarn into stitches.

6. A method according to claim 1 further comprising the following steps:

advancing first and second sets of said dial needles to a knitting position, forming pile loops between said dial needles raised to the knitting position, retracting one of said sets of dial needles after feeding a first base yarn thereto to a tuck-on-the-needle position while holding the other set of said dial needles in their clearing position, feeding a second base yarn to said set of needles held in the clearing position, retracting said second set of dial needles in the clearing position to a position similar to said needles in the tuck-on-the-needle position and retracting all needles to a cast-off position.

7. The pile fabric according to claim 6, wherein each course comprises two yarns which have been knitted into stitches in alternating fashion, whereby said first base yarn forms tuck loops in the intermediate wales and said second base yarn forms welt stitches therebetween, with both of said first and second base yarns alternatingly tying up the pile yarn inserted into all wales as a tuck stitch.

* * * * *